US006263692B1

(12) United States Patent
Nakanuma et al.

(10) Patent No.: US 6,263,692 B1
(45) Date of Patent: Jul. 24, 2001

(54) POWER-SOURCE COVERING DEVICE FOR AN OUTDOOR UNIT OF A SEPARATE-TYPE AIR CONDITIONING SYSTEMS

(75) Inventors: Mitsuo Nakanuma, Shiga-ken; Hideaki Nakagawa, Kusatsu, both of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/465,751

(22) Filed: Dec. 17, 1999

(30) Foreign Application Priority Data

Dec. 24, 1998 (JP) ..... 10-365814

(51) Int. Cl.[7] ..... F25D 19/00; F24F 11/02

(52) U.S. Cl. ..... 62/298

(58) Field of Search ..... 62/298, 262, 299, 62/295, 296, 259.1

(56) References Cited

U.S. PATENT DOCUMENTS 3,611,743 * 10/1971 Mangaro ..... 62/298 X
5,582,025 * 12/1996 Dubin et al. ..... 62/262
5,927,096 * 7/1999 Piccione ..... 62/298
6,023,939 * 2/2000 Correa ..... 62/262 X

* cited by examiner

*Primary Examiner*—Harry B. Tanner
(74) *Attorney, Agent, or Firm*—Parkhurst & Wendel, LLP

(57) ABSTRACT

The present invention has an object to provide a most preferred power-source covering device for an outdoor unit of an separate-type air conditioning systems, which is adapted to reduce vibration during the operation of the air conditioning system and heat conduction to a power cord from a pipe and a pipe connection valve. A power-source cover 6 is disposed to cover a terminal plate 3 for electrical interconnection between an indoor unit and an outdoor unit 1 via a power cord 2, and a pipe connection valve 5 interconnecting the indoor unit and the outdoor unit 1 via a pipe 4 thereby forming a refrigerant circuit. The power-source cover 6 includes an opening 10 which is located above the pipe connection valve 5 and through which the power cord 2 connected to the terminal plate 3 is led out.

3 Claims, 15 Drawing Sheets

POWER-SOURCE COVERING DEVICE FOR AN OUTDOOR UNIT OF A SEPARATE-TYPE AIR CONDITIONING SYSTEMS

FIELD OF THE INVENTION

The present invention relates to a power-source covering device for outdoor unit of separate-type air conditioning systems.

DESCRIPTION OF THE PRIOR ART

As shown in FIGS. 13 to 17, an outdoor unit 1 of a separate-type air conditioning system according to an example of the prior art of this type includes a terminal plate 3 which is disposed internally on a lateral side of an outdoor unit 1 of the system, electrically interconnecting an indoor unit and the outdoor unit 1 via a power cord 2, and a pipe connection valve 5 which is disposed in closer relation to the lateral side of a housing of the outdoor unit 1, interconnecting the indoor unit and the outdoor unit, via a pipe 4 so as to form a refrigerant circuit. The terminal plate 3 and the pipe connection valve 5 are covered by a power-source cover 6.

The power cord 2 connected to the terminal plate 3 is extended through a power-cord guide path 6*a* of the power-source cover 6 and led out to the outside thorough an opening for leading out the pipe 4 connected to the pipe connection valve 5.

The power-source cover 6 is formed of a synthetic resin material and mounted with an anti-fire safety device 8 of a sheet metal to protect an overall surface of a portion that covers a mounting portion of the terminal plate 3. The power-source cover 6 is formed with a projection 9 which is fused as engaged with an engagement hole 8*a* defined in the anti-fire safety device 8 thereby permitting the anti-fire safety device 8 to be mounted to the power-source cover 6.

In the prior-art arrangement abovementioned, however, the power cord 2 connected to the terminal plate 3 extends through the power-cord guide path 6*a* to be led out to the outside through the opening 7, thus coming closer to the pipe connection valve 5. Accordingly, a certain fashion to lead out the power cord may cause vibration during the operation of the air conditioning system. In addition, heat associated with temperature changes of the refrigerant is conducted from the pipe 4 and the pipe connection valve 5 which form a path of the refrigerant for air conditioning. This may cause influences, such as secular change, on the power cord 2 in proximity to the refrigerant path.

Additionally, the guide path 6*a* for the power cord 2 communicates to a place where the connection-pipe valve 5 is disposed and therefore, a fear exists that the guide path 6*a* may permit outside dusts or rain particles to enter the terminal plate 3 as an electrical connection portion and an internal control circuit of the outdoor unit 1.

Since formed of the synthetic resin material, the power-source cover 6 is mounted with the anti-fire safety device 8 of a metal sheet to protect an overall surface of a portion that covers the terminal plate 3 as the electrical connection portion. However, the power-source cover 6 employs the projection 9 as means for mounting the safety device, which must be fused to establish the mounting of the safety device. This results in increase in the number of mounting steps and costs.

The invention is directed to a solution to this problem and has an object to provide a most preferred power-source covering device for outdoor unit of the separate-type air conditioning system.

DISCLOSURE OF THE INVENTION

In one aspect of the invention, a power-source covering device for an outdoor unit of a separate-type air conditioning system comprises a power-source cover disposed to cover a terminal plate and a pipe connection valve internally on lateral side of the outdoor unit, said terminal plate electrically interconnecting an indoor unit and the outdoor unit via a power cord, said pipe connection valve interconnecting the indoor unit and the outdoor unit via a pipe thereby forming a refrigerant circuit, the power-source cover including an opening is located above the pipe connection valve and through which the power cord connected to the terminal plate is led out.

This arrangement prevents the power cord from being affected by the vibrations to be produced during the operation of the air conditioning system and by heat conduction from the pipe and the pipe connection valve.

In another aspect of the invention, the power-source covering device for an outdoor unit is characterized in that a blocking wall is provided in a power-cord guide path as interposed between the opening for leading out the power cord connected to the terminal plate and the pipe connection valve.

With this arrangement, the blocking wall can shut out the outside dusts or rain particles which tend to enter the terminal plate as the electrical connection portion and the internal control circuit of the outdoor unit.

In yet another aspect of the invention, the power-source covering device for an outdoor unit of an air conditioning system is characterized in that the power-source cover is formed of a resin material and with a projection for mounting an anti-fire safety device of a metal sheet to protect an overall surface of a portion that covers the terminal plate, and that the anti-fire safety device is formed with an engagement hole having sharply worked edges for engagement with the projection of the power-source cover.

The above arrangement dispenses with steps such as fusing of the projection for mounting the anti-fire safety device, thus offering a simple mounting of the safety device and accomplishing cost reduction.

PREFERRED EMBODIMENTS OF THE INVENTION

Figure 1:
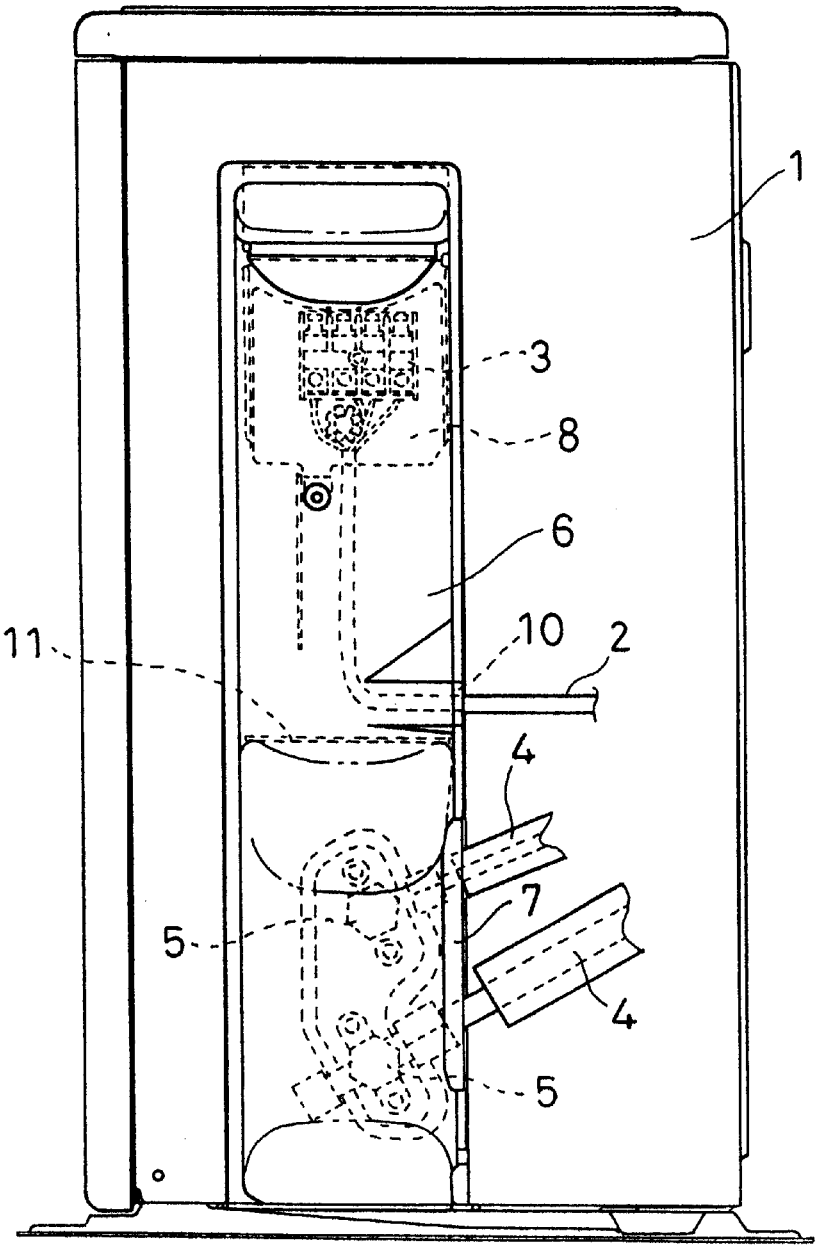
FIG. 1 is a side elevation showing a principal portion of an outdoor unit according to a first embodiment of the invention.

Now, preferred embodiments of the invention will hereinbelow be described with reference to the accompanying drawings. Incidentally, like portions to those of the aforementioned prior-art example will be represented by like reference numerals, respectively.

(First Embodiment)

Figure 2:
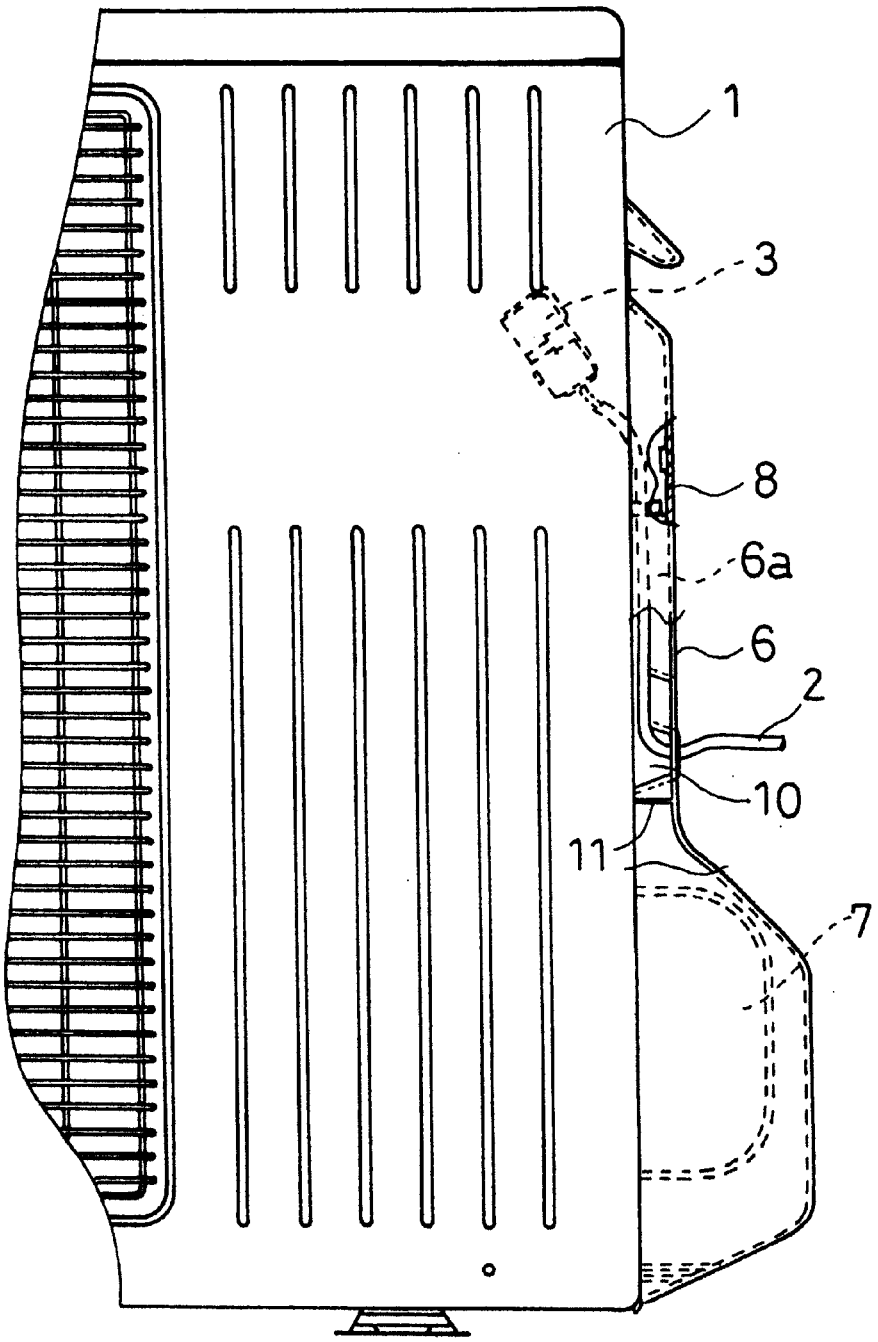
FIG. 2 is a front elevation showing a principal portion of the above outdoor unit.
Figure 3:
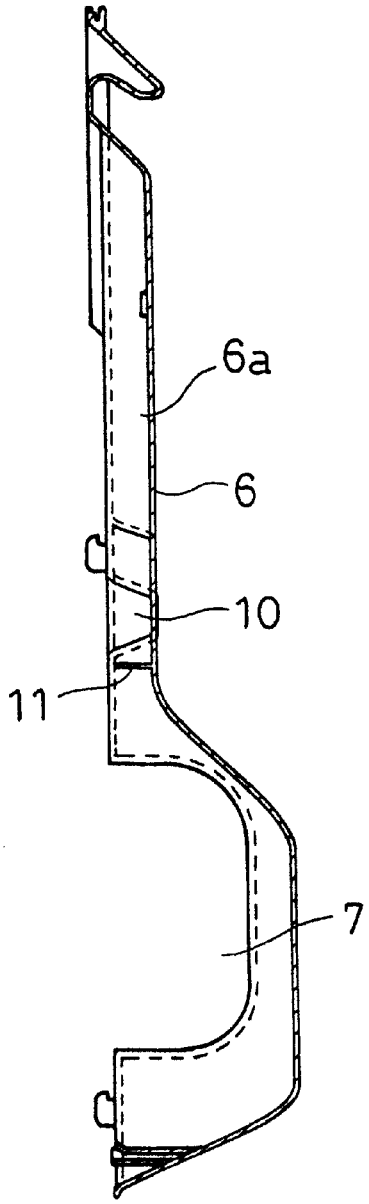
FIG. 3 is a sectional side elevation showing a power-source cover of the above outdoor unit.
Figure 4:
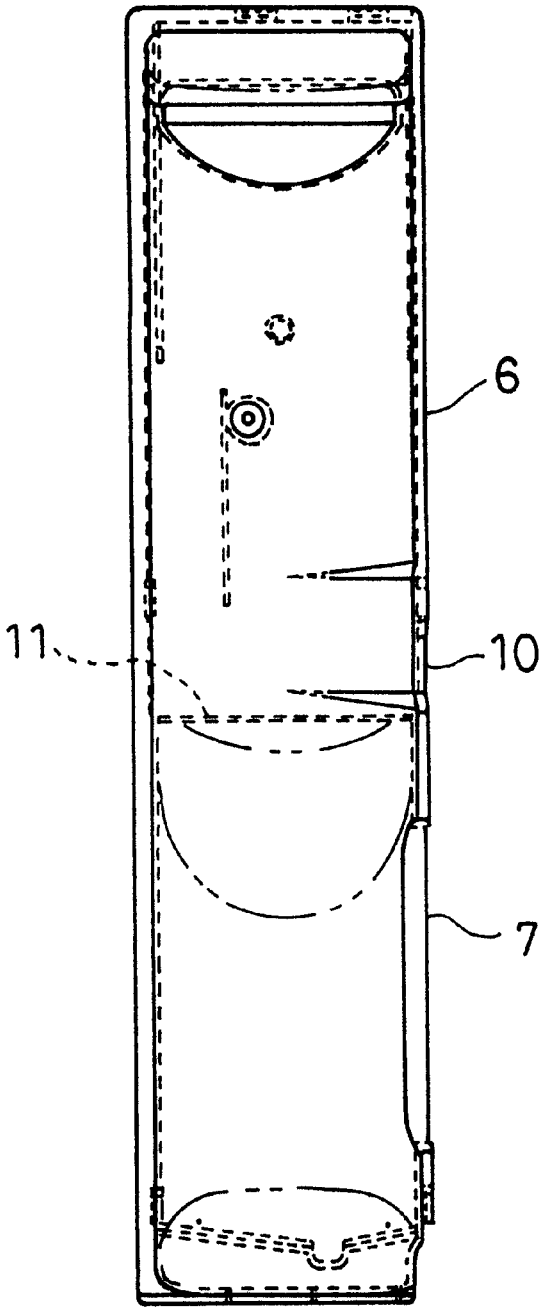
FIG. 4 is a front elevation showing the above power-source cover.
Figure 5:
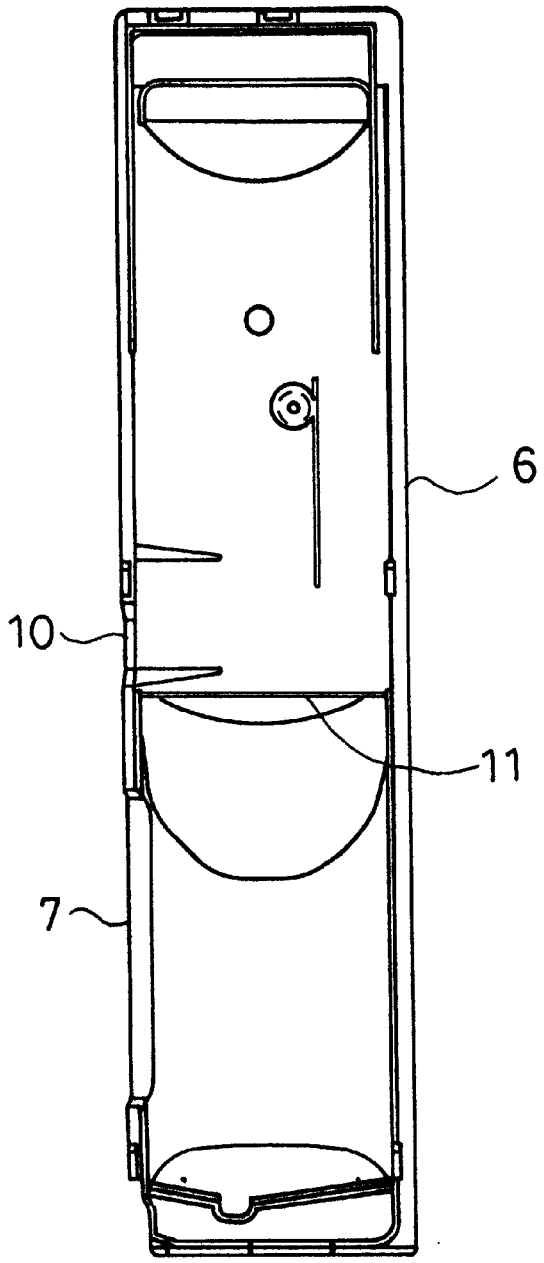
FIG. 5 is a rear elevation showing the above power-source cover.

Referring to FIGS. 1 to 5, a first embodiment of the invention is described. Indicated at 1 is an outdoor unit of a separate-type air conditioning system. Disposed at place internally on a lateral side of the outdoor unit 1 is a terminal plate 3 for interconnection between an indoor unit and the outdoor unit 1 via a power cord 2. On the other hand, a pipe connection valve 5 is disposed in closer relation to the lateral side of a housing of the outdoor unit 1, interconnecting the indoor unit and the outdoor unit 1 via a pipe 4 thereby forming a refrigerant circuit. The terminal plate 3 and the pipe connection valve 5 are covered by a power-source cover 6.

The power-source cover 6 is formed with an opening 10 for leading out the power cord 2 connected to the terminal plate 3, the opening 10 located above the pipe connection valve 5. The power-source cover 6 is also provided with a blocking wall 11 which is disposed in a power-cord guide path 6*a* between the opening 10 and the pipe connection valve 5.

the above arrangement, the opening 10 is located above the pipe connection valve 5 and therefore, the power cord 2 is spaced from the pipe connection valve 5. This reduces vibration during the operation of the air conditioning system as well as heat conduction to the power cord 2 from the pipe 4 and the pipe connection valve 5.

Additionally, the guide path 6*a* is shut off from the outside by the blocking wall 11 located between the opening 10 for leading out the power cord 2 and the pipe connection valve 5 so that outside dusts or rain particles are prevented from entering the terminal plate 3 as an electrical connection portion and an internal control circuit of the outdoor unit (Second Embodiment)

Figure 6:
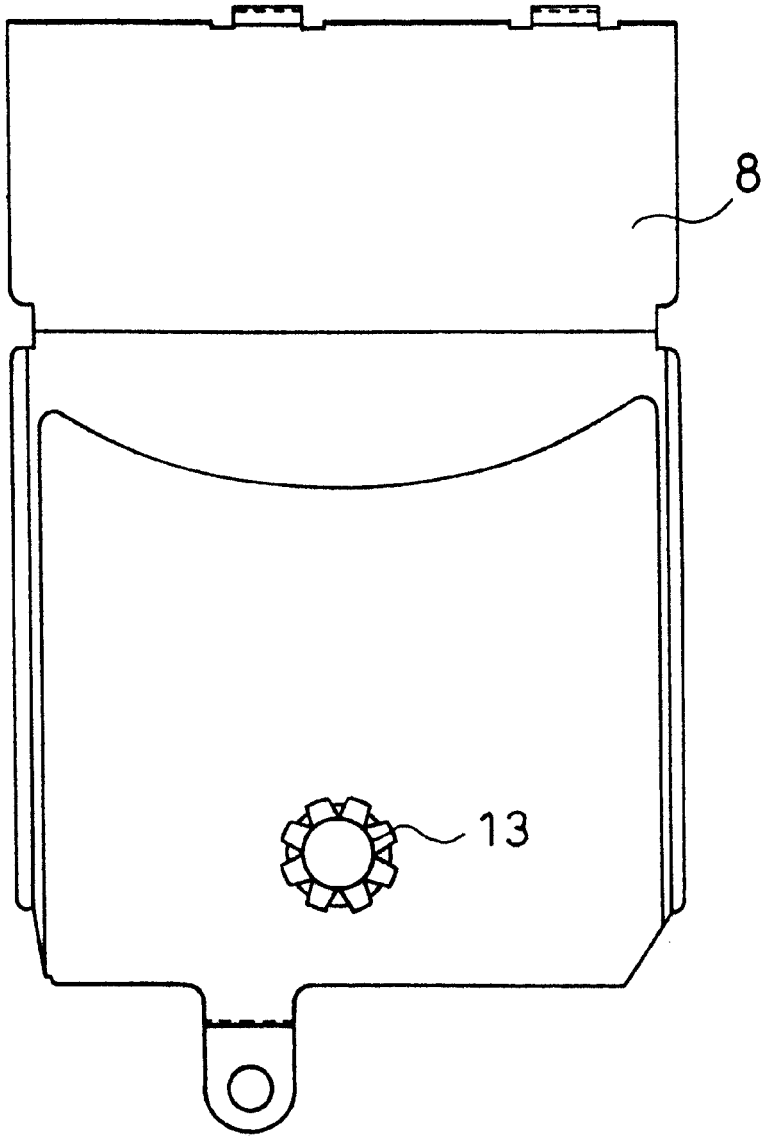
FIG. 6 is a front elevation showing an anti-fire safety device of an outdoor unit according to a second embodiment of the invention.
Figure 7:
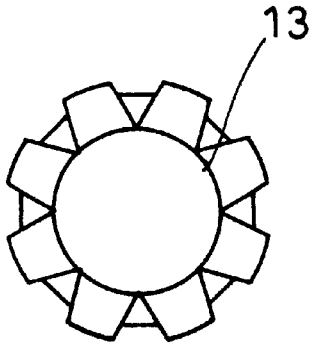
FIG. 7 is an enlarged front elevation showing a principal portion of an engagement hole of the above anti-fire safety device.
Figure 8:
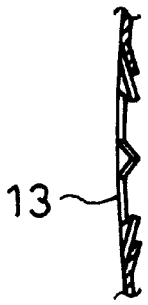
FIG. 8 is an enlarged sectional view showing the principal portion of the engagement hole of the above anti-fire safety device.
Figure 9:
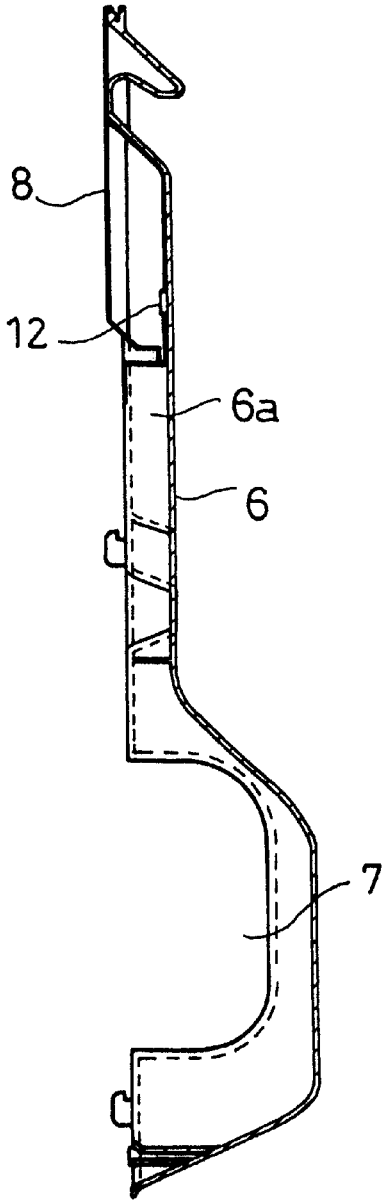
FIG. 9 is a sectional side elevation showing a power-source cover of the above outdoor unit.
Figure 10:
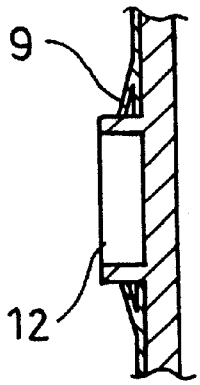
FIG. 10 is an enlarged sectional view showing a principal portion of a projection of the above power-source cover in engagement with the engagement hole of the anti-fire safety device.
Figure 11:
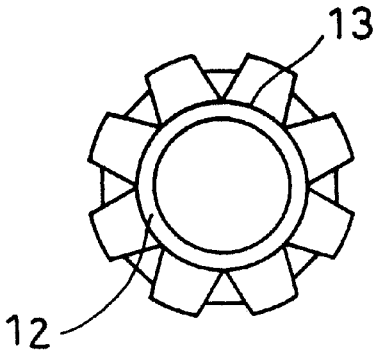
FIG. 11 is an enlarged front elevation showing the principal portion of the projection of the above power-source cover in engagement with the engagement hole of the anti-fire safety device.
Figure 12:
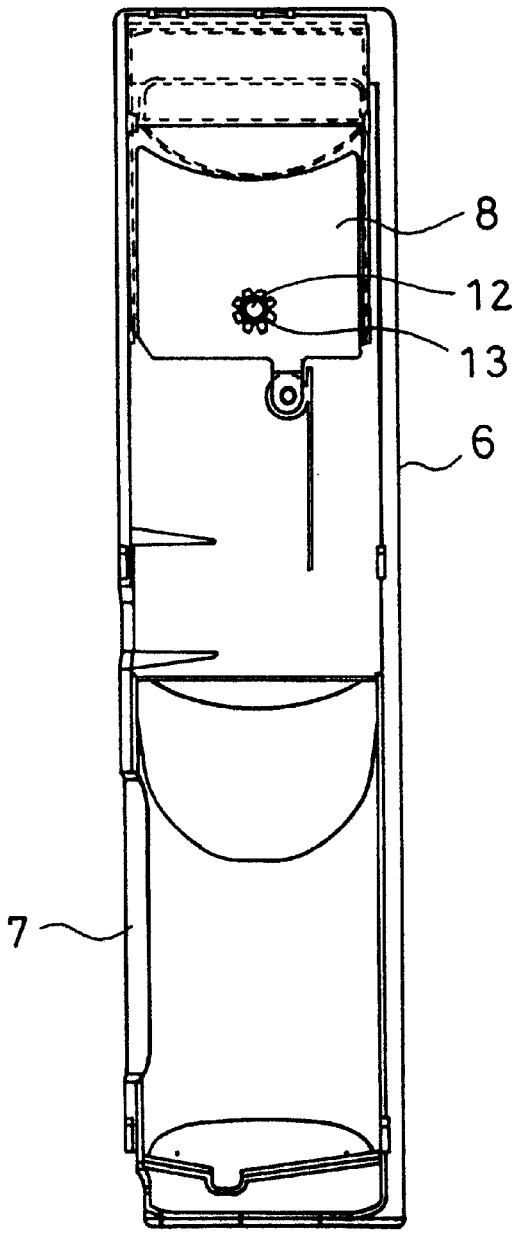
FIG. 12 is a rear elevation showing the above power-source cover.
Figure 13:
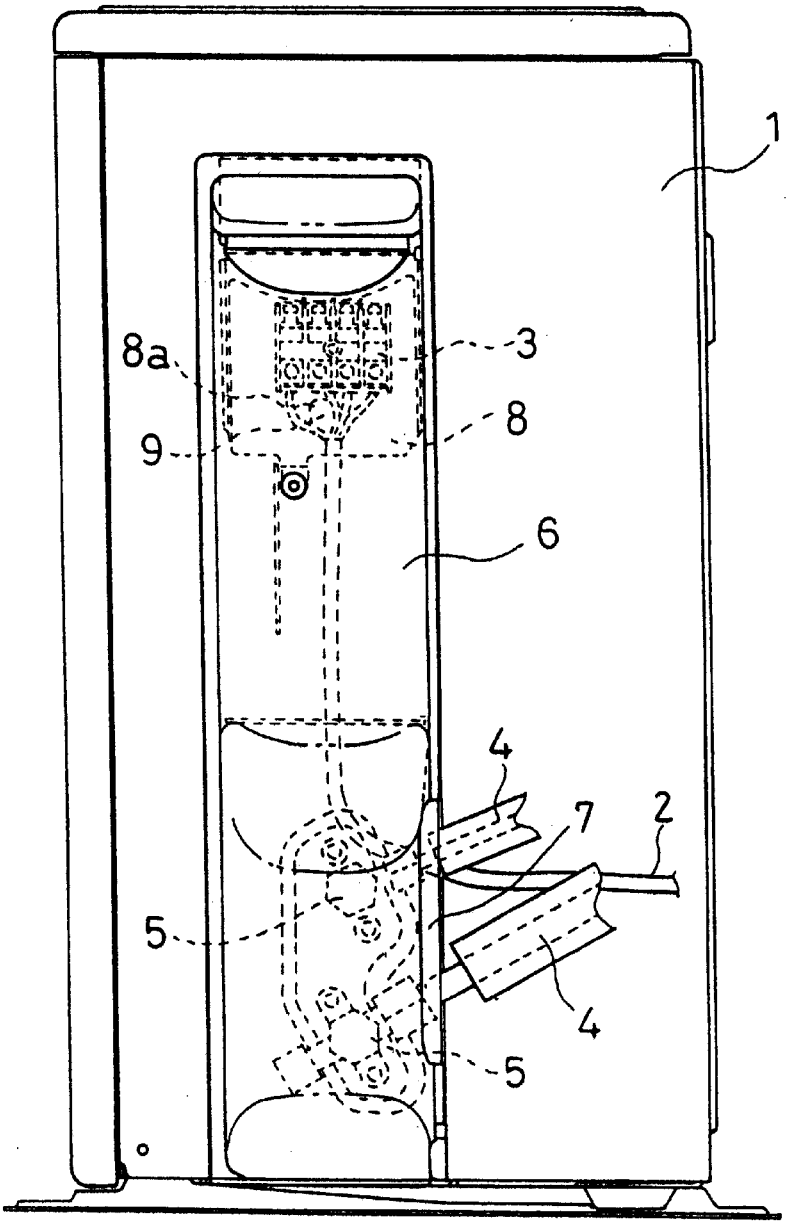
FIG.13 PRIOR ART
FIG. 13 is a side elevation showing a principal portion of an exemplary prior-art outdoor unit.
Figure 14:
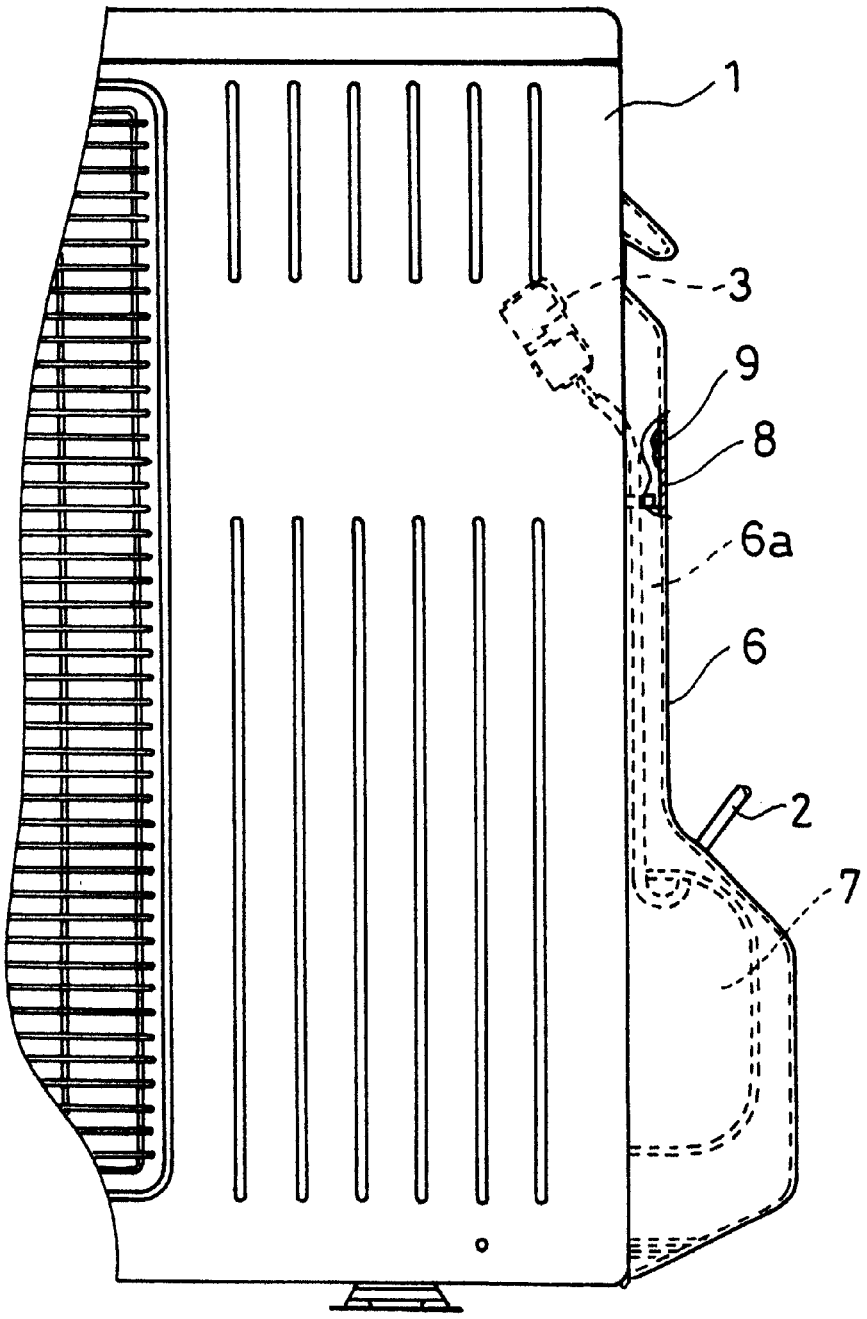
FIG.14 PRIOR ART
FIG. 14 is a front elevation showing the principal portion of the above outdoor unit.
Figure 15:
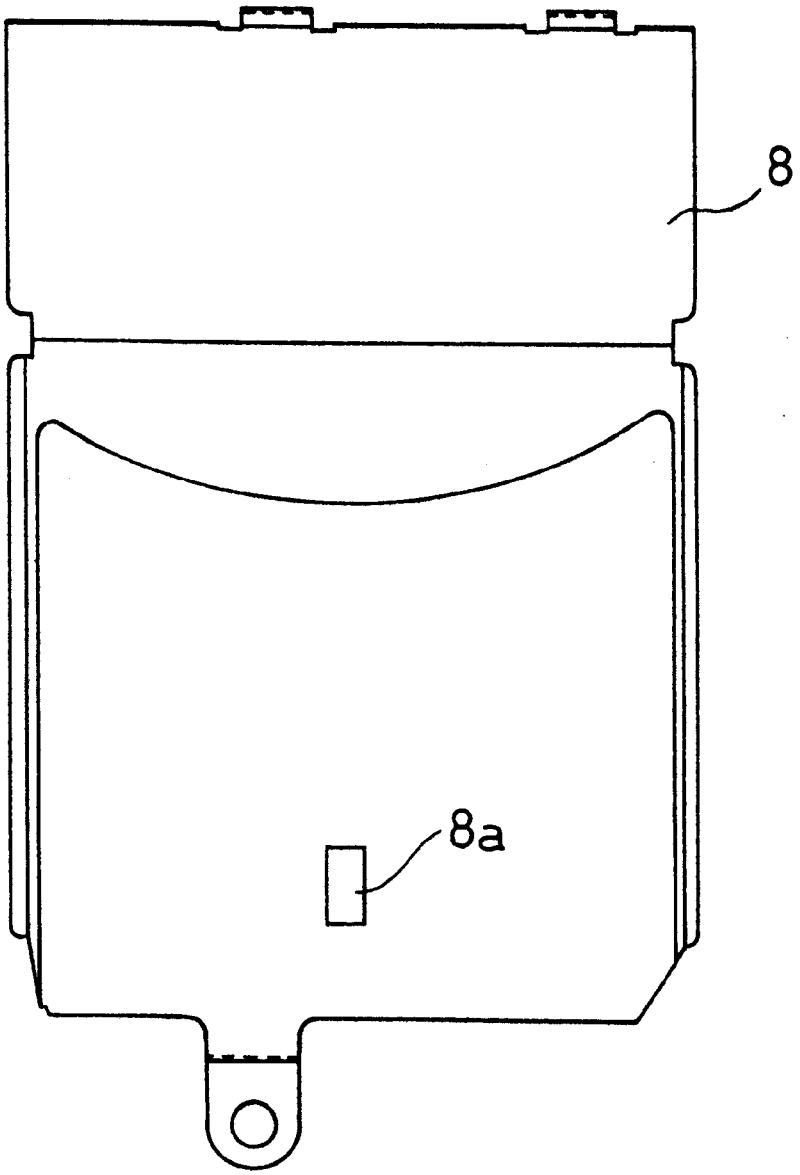
FIG.15 PRIOR ART
FIG. 15 is a front elevation showing an anti-fire safety device of the above outdoor unit.
Figure 16:
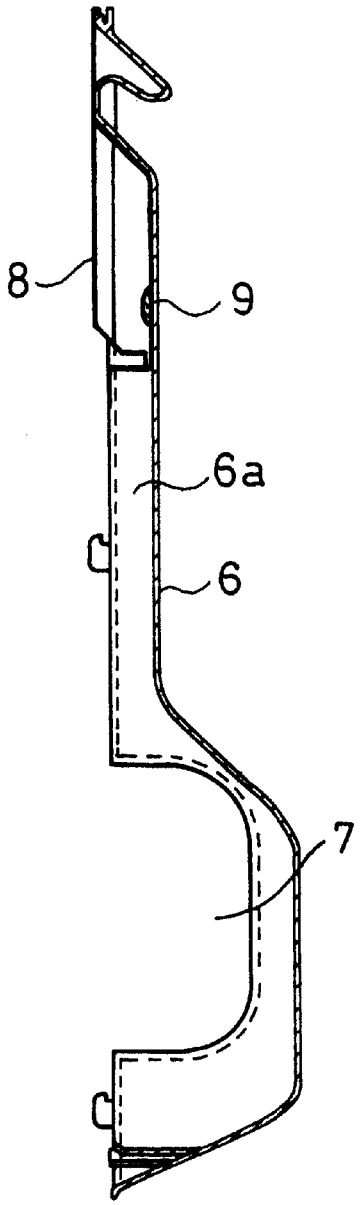
FIG.16 PRIOR ART
FIG. 16 is a sectional side elevation showing the above power-source cover.
Figure 17:
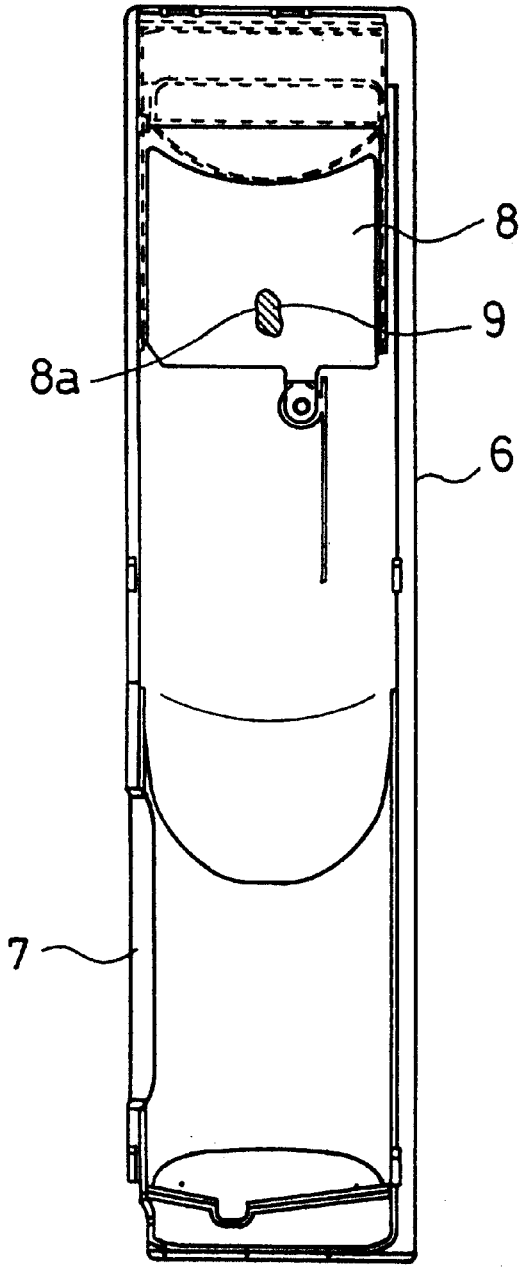
FIG.17 PRIOR ART
FIG. 17 is a rear elevation showing the above power-source cover.

Referring to FIGS. 6 to 12, a second embodiment of the invention is described. An anti-fire safety device 8 includes an engagement hole 13 having sharply worked edges for engagement with a projection 12 of the power-source cover 6. The power-source cover 6 is formed of a synthetic resin material and therefore, a surface portion that covers the terminal plate 3 for electrical interconnection between the indoor unit and the outdoor unit 1 via the power cord 2 is entirely protected by the anti-fire safety device 9 such as formed of a metal sheet. The power-source cover 6 is provided with the projection 12 permitting the mounting of the anti-fire safety device 8 thereto. The anti-fire safety device 8 is mounted by way of engagement between the projection 12 of the power-source cover 6 and the engagement hole 13 having its sharply worked edges.

In the above arrangement, the anti-fire safety device 8 is readily mounted by securing its engagement hole 13 having sharply worked edges to the projection 12 formed on the power-source cover 6. Thus are reduced the number of mounting steps and costs.

What is claimed is:

1. A power-source covering device for an outdoor unit of a separate-type air conditioning system, comprising a power-source cover (6) covering a terminal plate (3) and a pipe connection valve (5) internally on lateral side of the outdoor unit, said terminal plate (3) electrically interconnecting an indoor unit and the outdoor unit (1) via a power cord (2), said the pipe connection valve (5) for interconnecting the indoor unit and the outdoor unit via a pipe (4) thereby forming a refrigerant circuit, the power-source cover (6) including an opening (10) which is located above the pipe connection valve (5) and through which the power cord connected to said terminal plate (3) is led out.

2. The power-source covering device for an outdoor unit of a separate-type air conditioning system as claimed in claim 1, wherein a blocking wall (11) is provided in a power-cord guide path (6*a*) between the opening (10) for leading out the power cord (2) connected to the terminal plate (3) and the pipe connection valve (5).

3. The power-source covering device for an outdoor unit of a separate-type air conditioning system as claimed in claim 1, wherein the power-source cover (6) is formed of a resin material and is provided with a projection (12) for mounting anti-fire safety device (8) of a metal sheet to protect an overall surface of a portion that covers the terminal plate (3), and wherein said anti-fire safety device (8) is formed with an engagement hole (13) having sharply worked edges for engagement with the projection (12) of said power-source cover (6).

* * * * *